US009651016B2

(12) United States Patent
Pawlak et al.

(10) Patent No.: US 9,651,016 B2
(45) Date of Patent: May 16, 2017

(54) IGNITION SYSTEM FOR AN INTERNAL COMBUSTION ENGINE

(71) Applicant: Robert Bosch GmbH, Stuttgart (DE)

(72) Inventors: Thomas Pawlak, Immenstadt (DE); Tim Skowronek, Missen-Wilhams (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 14/426,514

(22) PCT Filed: Sep. 12, 2013

(86) PCT No.: PCT/EP2013/068908
§ 371 (c)(1),
(2) Date: Mar. 6, 2015

(87) PCT Pub. No.: WO2014/041070
PCT Pub. Date: Mar. 20, 2014

(65) Prior Publication Data

US 2015/0219063 A1 Aug. 6, 2015

(30) Foreign Application Priority Data

Sep. 12, 2012 (DE) ..... 10 2012 216 182
Sep. 11, 2013 (DE) ..... 10 2013 218 227

(51) Int. Cl.
*F02P 7/03* (2006.01)
*H01T 15/00* (2006.01)
(Continued)

(52) U.S. Cl.
CPC *F02P 7/03* (2013.01); *F02P 3/01* (2013.01); *F02P 15/10* (2013.01); *H01T 15/00* (2013.01)

(58) Field of Classification Search
CPC . F02D 41/221; F02P 1/086; F02P 3/01; F02P 3/08; F02P 3/0884; F02P 7/03;
(Continued)

(56) References Cited

U.S. PATENT DOCUMENTS 3,760,782 A * 9/1973 Meyer ..... F02P 3/005 123/604
5,097,815 A * 3/1992 Oota ..... F02P 15/008 123/606
(Continued)

FOREIGN PATENT DOCUMENTS

CA 2 296 615 7/2001
CN 2527734 Y 12/2002
(Continued)

OTHER PUBLICATIONS

International Search Report for PCT/EP2013/068908, dated Feb. 20, 2014.

*Primary Examiner* — Hung Q Nguyen
*Assistant Examiner* — Johnny H Hoang
(74) *Attorney, Agent, or Firm* — Norton Rose Fulbright US LLP; Gerard A. Messina

(57) ABSTRACT

An ignition system includes: a step-up transformer having a primary side and a secondary side; an electrical energy source configured to be selectably connected to the primary side; a spark gap which is configured to guide a current transferred by the step-up transformer to the secondary side. The step-up transformer has a bypass for transferring electrical energy from the electrical energy source to the secondary side. The ignition system is configured to couple electrical energy in series or in parallel to the secondary side of the high voltage generator for the purpose of maintaining an ignition spark as an electrical voltage in the form of a controlled pulse sequence, e.g., within the kilo-hertz range.

19 Claims, 6 Drawing Sheets

(51) Int. Cl.
*F02P 3/01* (2006.01)
*F02P 15/10* (2006.01)

(58) Field of Classification Search
CPC ... F02P 9/00; F02P 9/007; F02P 15/10; H01T 15/00
USPC ..... 123/594, 596, 606, 609, 611, 618, 123/620–622, 627, 628, 636, 640, 641
See application file for complete search history.

(56) References Cited

U.S. PATENT DOCUMENTS

| | | | | |
|---|---|---|---|---|
| 5,197,448 | A | 3/1993 | Porecca et al. | |
| 5,654,868 | A | 8/1997 | Buer | |
| 6,729,317 | B2 | 5/2004 | Kraus | |
| 2002/0121272 | A1 | 9/2002 | Kraus | |
| 2004/0000878 | A1 | 1/2004 | Petruska et al. | |
| 2012/0017881 | A1* | 1/2012 | Kataoka | F02P 3/051 123/621 |
| 2013/0241429 | A1* | 9/2013 | Ruan | F02P 3/053 315/220 |
| 2014/0109886 | A1* | 4/2014 | Singleton | F02P 3/02 123/594 |

FOREIGN PATENT DOCUMENTS

| | | | |
|---|---|---|---|
| CN | 1533475 | A | 9/2004 |
| CN | 1675464 | A | 9/2005 |
| DE | 198 38 003 | | 3/2000 |
| DE | 10 226 607 | | 12/2002 |
| DE | 10 2005 012 282 | | 9/2006 |
| DE | 10 2005 034 294 | | 1/2007 |
| DE | 10 2006 040982 | | 3/2008 |
| EP | 0 181 961 | | 5/1986 |
| EP | 1 199 470 | | 4/2002 |
| EP | 2 325 476 | | 5/2011 |
| GB | 717 676 | | 3/1954 |
| JP | S60 169675 | | 9/1985 |
| JP | S60-204965 | A | 10/1985 |
| JP | H01-142269 | A | 6/1989 |
| JP | H03-106434 | A | 5/1991 |
| JP | H05-164028 | A | 6/1993 |
| JP | H06-213119 | A | 8/1994 |
| JP | H07-174063 | A | 7/1995 |
| JP | H08-338298 | A | 12/1996 |
| JP | H09-144641 | A | 6/1997 |
| JP | 2015-529774 | A | 10/2015 |
| JP | 2015-531153 | A | 10/2015 |
| WO | WO 93/04279 | | 3/1993 |
| WO | WO 2009/106100 | | 9/2009 |
| WO | WO 2014/041050 | | 3/2014 |

* cited by examiner

IGNITION SYSTEM FOR AN INTERNAL COMBUSTION ENGINE

BACKGROUND OF THE INVENTION

1. Field of the Invention

The present invention relates to an ignition system for an internal combustion engine which is subject to increased requirements due to (high) boosting and diluted, lowly flammable mixtures ($\lambda >> 1$, lean layer concepts, high AGR rates).

2. Description of the Related Art

Published U.K. patent document GB717676 shows a step-up transformer for an ignition system in which a circuit component, which is controlled via a vibration switch, is used in the manner of a boost converter in order to supply a spark which is generated via the step-up transformer with electrical energy.

Published international patent application document WO 2009/106100 A1 shows a circuit configuration which is constructed according to a high voltage capacitor ignition system and in which energy, which is stored in a capacitor, is guided, on the one hand, to the primary side of a transformer and, on the other hand, toward a spark gap via a bypass having a diode.

US patent application publication 2004/000878 A1 shows an ignition system in which a secondary-side storage including multiple capacitors is charged in order to supply a spark which is generated with the aid of a transformer with electrical energy.

Published international patent application document WO 9304279 A1 shows an ignition system including two energy sources. One energy source transfers electrical energy with the aid of a transformer to a spark gap while the second energy source is situated between a secondary-side terminal of the transformer and the electrical ground.

It is known that ignition systems for internal combustion engines are based on a high voltage generator, e.g., a step-up transformer, with the aid of which energy originating from the vehicle battery or a generator is converted to high voltages with the aid of which a spark gap is supplied for the purpose of igniting a combustible mixture in the internal combustion engine. For this purpose, a current flowing through the step-up transformer is abruptly interrupted, whereupon the energy stored in the magnetic field of the step-up transformer is discharged in the form of a spark. In order to ensure that the combustible mixture ignites particularly reliably, ignition systems are known from the related art which have multiple chronologically consecutive spark events for the purpose of increasing the probability of the presence of an ignitable mixture at the location of one of the spark events.

Another problem known from the related art is that all the electrical energy which is converted during the spark discharge must be stored in the high voltage generator, whereby the high voltage generator becomes comparably large and thus expensive and requires a lot of installation space.

Due to the discharge characteristic of the high voltage generator, such a high current flows, in particular, at the beginning of the spark discharge that the electrodes of the spark gap are eroded. However, such a high current is not physically necessary to ensure a spark. In this way, only the required duration of the spark discharge is ensured with the acceptance of the previously described disadvantages.

It is therefore the object of the present invention to eliminate the previously mentioned disadvantages of the related art.

BRIEF SUMMARY OF THE INVENTION

The previously mentioned object is achieved according to the present invention with the aid of an ignition system as well as a method for generating and maintaining an ignition spark. As is already known from the related art, the ignition system according to the present invention also includes a high voltage generator, such as a step-up transformer, including a primary side, which is connected to an energy source, and a secondary side, which is connected to a spark gap. The principle functionality of the high voltage generator also corresponds to that known from the related art and therefore needs no further explanation. Furthermore, a spark gap which is also known form the related art is provided which is configured to guide a current transferred by the high voltage generator to the secondary side. In this case, the spark gap may be, for example, situated in a spark plug. Since lower voltages are necessary for maintaining an existing electric arc across the spark gap than for initially generating same, a bypass is provided according to the present invention which is able to transfer electrical energy from the electrical energy source to the secondary side past the high voltage generator. In this case, a plurality of possible circuits is conceivable as the bypass, individual ones of which are discussed in the following in greater detail. In order to eliminate the disadvantages known from the related art, the bypass is configured to maintain an electric arc generated with the aid of the high voltage generator longer and more reliably across the spark gap than it would be possible with the aid of the magnetic energy stored in the high voltage generator. For this purpose, the ignition system is configured to couple electrical energy in series or in parallel to the secondary side of the high voltage generator for the purpose of maintaining an ignition spark as an electrical voltage in the form of a controlled pulse sequence, in particular within the kilo-hertz range. Within the scope of the present invention, a voltage signal which has been adapted to the instantaneous operating conditions via a control signal with regard to its pulse-pause ratio and/or with regard to its base frequency may be, for example, understood to mean a controlled pulse sequence. The pulses may be superimposed to a direct voltage as it occurs, for example, when a boost converter is used. The voltage level may, for example, orient itself toward an electrical variable which provides information about an operating state at the spark gap (e.g., current and/or voltage). In this way, the controlled pulse sequence may be used to maintain the spark energy of an ignition spark in a predefined range and, in particular, to prevent an interruption of the spark at the spark gap. In this way, spark durations of preferably 0.5 ms to 5 ms may be generated in the case of spark currents preferably ranging from 30 mA to 100 mA of different polarities (polarities of the voltage supply). This offers the advantage that the energy transferred via the high voltage generator is strongly reduced and thus the initial spark current decreases, whereby spark erosion at the electrodes of the spark gap may be reduced and the high voltage generator may be designed considerably smaller than is the case in the related art.

The high voltage generator is preferably designed as a step-up transformer and has a primary coil on its primary side and a secondary coil on its secondary side. Both coils may be magnetically coupled to one another with the aid of a transformer core (e.g., made of iron sheets). Here, the bypass is configured to additionally transfer an electrical voltage to the step-up transformer which is added to a transformed voltage applied at the secondary coil of the step-up transformer. In this way, the bypass facilitates a "support" of the spark current by inputting additional electrical energy to the spark gap.

Alternatively, the high voltage generator may be designed as a high voltage capacitor ignition (HCI) system. Such and other systems for generating high voltage as well as their functionality are known and described in the related art, so that an explanation in greater detail is not necessary in this case.

It is furthermore preferred that the bypass may include one or (advantageously for jointly handling the occasionally occurring high voltages) multiple energy stores, preferably one capacitance or multiple capacitances, switched in series and/or in parallel, the first terminal of which is connected to a secondary-side terminal of the high voltage generator and the second terminal of which is connected to the electrical ground, an inductance being in particular switchably provided between the energy source and the capacitance. In this way, the bypass provides a secondary-side energy store with the aid of which the subsiding electrical signal in the secondary coil of the high voltage generator may be supported starting from a predefined point in time or starting from a predefined current intensity. As explained in greater detail in conjunction with the appended drawing figures, an inductance may be switchably provided between the energy source and the capacitance for the purpose of charging the capacitance. The capacitance and the inductance form in the case of a closed switch an oscillating circuit, with the aid of which a temporary increase in the electrical potential is possible at the first terminal of the capacitance. In particular in the case that a current is initially conducted through the inductance and a discharge of the energy stored in the inductance is forced to the capacitance by a switching operation, very high voltages may be provided in the case of suitably selected switching times without having to buffer the necessary energy within a high voltage generator.

It is furthermore preferred that between the inductance and the capacitance, a nonlinear two-terminal network, which has a flow direction in the direction of the capacitance, is provided in the form of a diode, for example. In this way, it may be prevented that energy "escapes" from the capacitance in the direction of the inductance in the case of a closed switch. If within the scope of the present invention a "diode" as a nonlinear two-terminal network is discussed, it takes place for the sake of conciseness and readability. It is apparent to those skilled in the art that voltages, occasionally present across the nonlinear two-terminal network referred to as a diode, may be handled better and more reliably, if necessary, jointly by multiple components, such as by diodes switched in series. For this purpose, each of the diodes may be designed as a Zener diode. If necessary, an included switch may also be advantageously closed in response to a signal when a predefined first current direction is to be expected in the nonlinear branch and then opened when a predefined second (opposite) current direction is to be expected in the nonlinear branch. If in the following multiple diodes are advantageously used and supplied with high voltages, the aforementioned points also apply accordingly. In particular, a switchable connection may be provided between a shared terminal between the inductance and the diode on the one hand, and the electrical ground on the other hand. It is possible in this way to provoke a current flow through the inductance in the case of a closed switch and thus to redirect the current to the capacitance via the diode by opening the switch. By suitably selecting the pulse-pause ratio and/or the activation frequency a high voltage may be generated with a very high degree of efficiency.

It is furthermore preferred that a current measuring means which may be designed as a shunt resistor, for example, may be provided, for example, between an output terminal of the high voltage generator and the capacitance. This current measuring means may furthermore be situated between the capacitance and the ground or in the path of the diode, for example, and configured to output a signal to a switch in the bypass so that the latter may respond to a critical current intensity in the secondary-side loop. Alternatively or additionally, an overvoltage protector, e.g., a diode, which protects the capacitance against overvoltage, may be provided in parallel to the capacitance. For example, a Zener diode may be used in the blocking direction to provide relief in the case of an excessively high voltage across the capacitance.

Alternatively or additionally, a voltage measurement and/or a power measurement may be carried out, e.g., across the capacitance, to receive information about the ignition current and/or the ignition power.

It is furthermore preferred that the inductance may also be designed as a transformer having a primary side and a secondary side, a first terminal of the primary side being connected to the energy source and a second terminal of the primary side being connected via a switch to the electrical ground. Furthermore, a first terminal of the secondary side of the transformer is connected to the energy source and a second terminal of the secondary side of the transformer is connected to the diode, as described previously. By suitably selecting the transfer ratio, a switch which is provided on the primary side may in this way be used to switch a current flowing on the secondary side. The transmission ratio results in favorable conditions for dimensioning the switch and, in this way, in a more reliable and cost-effective implementation of the ignition system according to the present invention.

According to another aspect of the present invention, a method for generating an ignition spark for an internal combustion engine is provided. Here, an ignition spark is initially generated with the aid of electrical energy which is retrieved from an energy source and which is provided to a spark gap via a high voltage generator having a primary side and a secondary side. According to the present invention, the ignition spark is maintained with the aid of a controlled pulsed electrical energy which is transferred from the energy source to the secondary side via a bypass. For the basic method according to this aspect of the present invention as well as for the refinements described in the following it applies that the statements made in conjunction with the ignition system according to the present invention apply accordingly.

It is furthermore preferred that the electrical energy for maintaining the ignition spark is coupled as an electrical voltage in series or in parallel to the secondary side of the high voltage generator. In other words, a coupling section of the bypass forms in conjunction with the secondary-side coil of the high voltage generator a loop whose voltage is in parallel to the spark gap. In this case, the electrical energy for maintaining the ignition spark may be retrieved from the energy source as a controlled pulse sequence, in particular in the kilo-hertz range, preferably between 10 kHz and 100 kHz. In the case of the aforementioned sampling in the kHz range, there is the possibility of generating voltages in the range of up to several 1000 V at an improved degree of efficiency which may be used for supporting the ignition spark when the energy stored in the high voltage generator is no longer sufficient for reliably maintaining the electric arc. Beyond the already mentioned advantages, the application of the present invention offers advantages with regard to the degree of efficiency of the electrical ignition system as well as new diagnostic function possibilities.

Exemplary embodiments of the present invention are described in detail below with reference to the attached drawings.

DETAILED DESCRIPTION OF THE INVENTION

Figure 1:
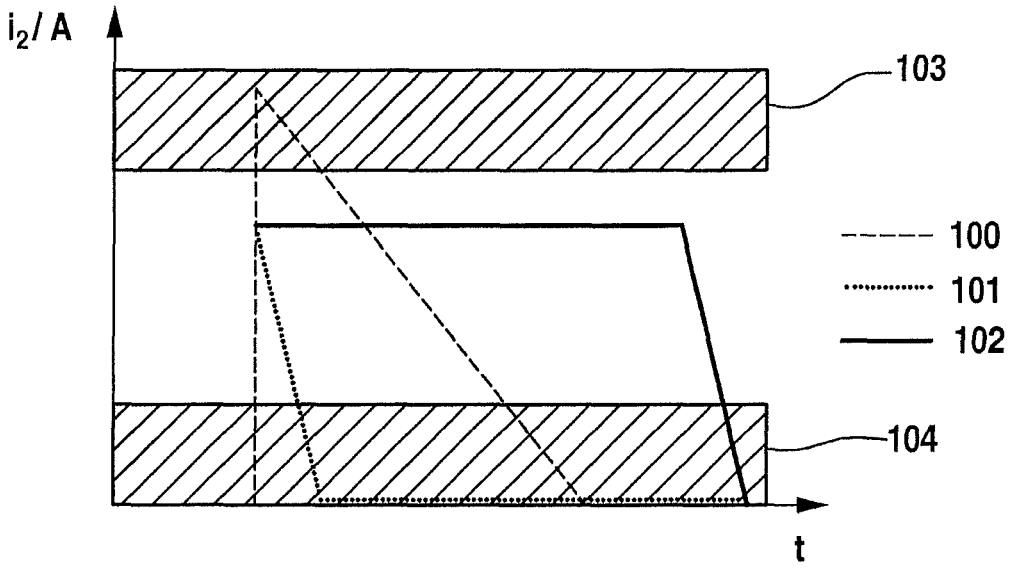
FIG. 1 shows a time diagram for comparison of ignition currents appearing according to the related art and the present invention.

FIG. 1 shows a time diagram of the ignition current, i.e., of that current which flows within the secondary-side coil of the step-up transformer as the high voltage generator during penetration of the spark gap. Here, an area 103 is marked within which the current is high enough for the electrodes of the spark plug to be damaged by increased erosion. Area 104 marks those (low) current intensities within which a necessary stability of the electric arc for igniting an ignitable mixture cannot be ensured. As described at the outset, a current 100 which is implemented by ignition systems of the related art therefore flows after a steep ascent into the electrode endangering area 103 and drops essentially linearly afterward (in approximation to an exponential discharge function). In contrast thereto, the energy which is guided to the spark gap according to the present invention divides up into two energy parts which are provided by one current flowing through the step-up transformer for the purpose of generating an ignition spark and by one current flowing through the bypass for the purpose of maintaining an ignition spark. After the step-up transformer (having smaller dimensions as compared to the related art) has generated an electric arc, the current would steeply (according to the discharge of the small secondary inductance—with reference to conventional secondary inductances) decrease (cf. representation in FIG. 1, 101) without the bypass according to the present invention and it would already "disappear" in area 104 shortly after its formation. With the aid of the bypass according to the present invention, the current intensity on the secondary side, more precisely in the spark gap, may be maintained over a significantly longer period of time between critical areas 103 and 104 (cf. representation in FIG. 1, 102). After turning off the bypass, the energy stored in the secondary coil is discharged, as in the related art, thus resulting in a steeply dropping spark current. This results in an overall current which, however, immerges into unstable area 104 considerably later than current intensity 100 of the known ignition system.

Figure 2:
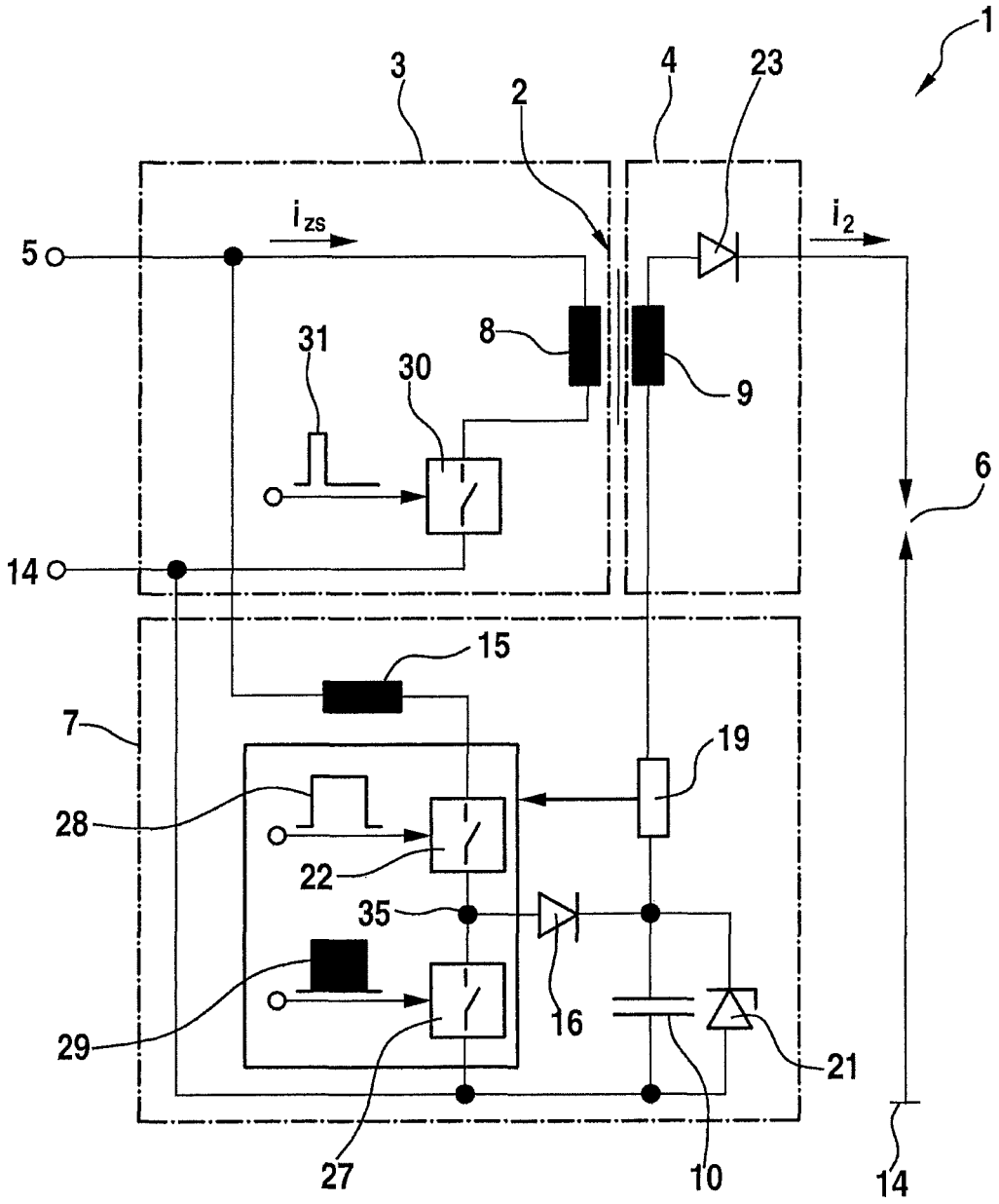
FIG. 2 shows a wiring diagram according to a first exemplary embodiment of an ignition system according to the present invention.

FIG. 2 shows a circuit using which current profiles 101, 102 illustrated in FIG. 1 may be implemented. An ignition system 1 is illustrated which includes a step-up transformer 2 as the high voltage generator whose primary side 3 may be supplied with electrical energy via a first switch 30 from an electrical energy source 5. Secondary side 4 of step-up transformer 2 is supplied with electrical energy via an inductive coupling of primary coil 8 and secondary coil 9 and includes a diode 23 known from the related art for switch-on spark suppression, this diode being alternatively exchangeable by diode 21. In a loop having secondary coil 9 and diode 23, a spark gap 6 against ground 14 is provided with the aid of which ignition current $i_2$ is supposed to ignite the combustible gas mixture. According to the present invention, a bypass 7 (enclosed by a dot and dash line) is provided between electrical energy source 5 and secondary side 4 of step-up transformer 2. For this purpose, an inductance 15 is connected via a switch 22 and a diode 16 to a capacitance 10 whose one end is connected to secondary coil 9 and whose other end is connected to electrical ground 14. The inductance is used, in this case, as an energy store for maintaining a current flow. Diode 16 is conductively oriented in the direction of capacitance 10. The design of bypass 7 is thus, for example, comparable to a boost converter. A shunt 19 is provided between capacitance 10 and secondary coil 9 as a current measuring means or voltage measuring means whose measuring signal is supplied to switch 22 as well as switch 27. In this way, switches 22, 27 are configured to respond to a defined range of current intensity $i_2$ through secondary coil 9. The terminal of switch 22 which faces diode 16 is connectable to electrical ground 14 via a further switch 27. To protect capacitance 10, a Zener diode 21 is switched in the blocking direction in parallel to capacitance 10. Furthermore, switching signals 28, 29 are indicated with the aid of which switches 22, 27 may be activated. While switching signal 28 represents a switch-on and "remaining close" for an entire ignition cycle, switching signal 29 plots a simultaneous alternating signal between "closed" and "open." In the case of closed switch 22, inductance 15 is supplied via electrical energy source 5 with a current which flows directly into electrical ground 14 in the case of closed switches 22, 27. In the case of open switch 27, the current is guided to capacitor 10 via diode 16 and terminal 35. The voltage appearing in capacitor 10 as a response to the current is added to the voltage dropping at secondary coil 9 of step-up transformer 2, whereby the electric arc is supported at spark gap 6. In this case, capacitor 10, however, discharges so that by closing switch 27 energy may be transported to the magnetic field of inductance 15 in order to recharge this energy to capacitor 10 in the case switch 27 is reopened. It is apparent that activation 31 of switch 30 provided in primary side 3 is kept considerably shorter than is the case for switches 22 and 27. These procedures are discussed in greater detail in conjunction with FIG. 3. Since switch 22 does not assume a specific function for the procedures according to the present invention, but merely switches the circuit on and off, it is merely optional and may therefore be dispensed with.

Figure 3:
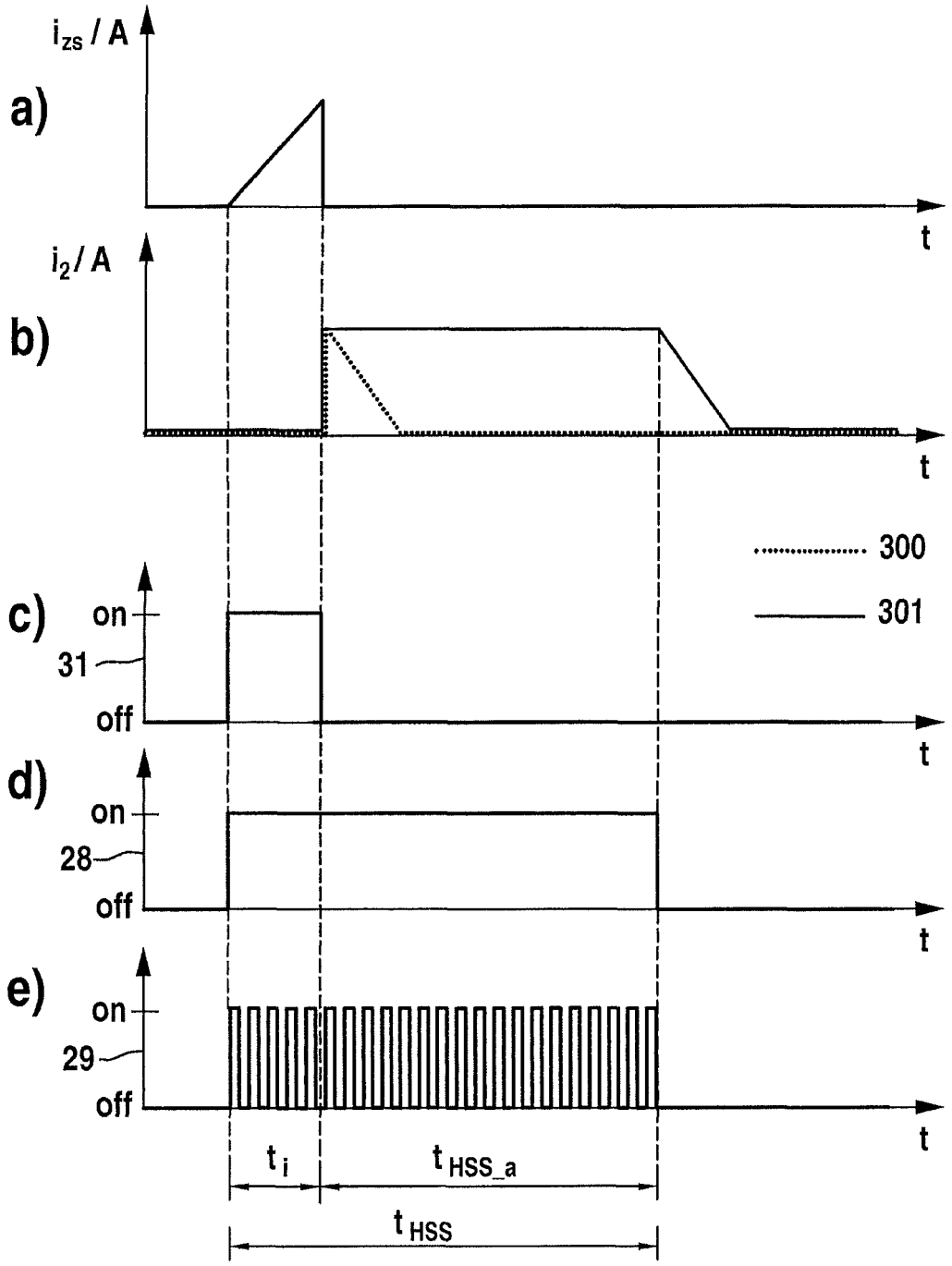
FIG. 3 shows representations of current-time diagrams as well as the associated switching sequences for the circuit shown in FIG. 2.

FIG. 3 shows a diagram of a short and steep ascent of primary coil current $i_{ZS}$ which appears during the time when switch 30 (see diagram 3*c*) is in the conductive state ("ON"). By turning off switch 30, primary coil current $i_{ZS}$ also drops to 0 A. Diagram b shows the profiles of secondary coil current $i_2$ as they result for a utilization of system 1 illustrated in FIG. 2 with (301) and without (300) a bypass. As soon as primary coil current $i_{ZS}$ results in 0 due to an opening of switch 30 and thus the magnetic energy stored in the step-up transformer discharges in the form of an electric arc across spark gap 6, a secondary coil current $i_2$ appears which drops rapidly toward 0 without a bypass (300). In contrast thereto, an essentially constant secondary coil current $i_2$ (301) is driven across spark gap 6 by a closed switch 22 (see diagram d) and a pulse-like activation (see diagram e, switching signal 29) of switch 27. Secondary [coil] current $i_2$ is a function of the burning voltage across spark gap 6 and, for the sake of simplicity, a constant burning voltage is assumed in this case. Only after the interruption of bypass 7 by opening switch 22 and by opening switch 27 does secondary coil current $i_2$ finally drop toward 0. It is apparent from diagram b) that the dropping edge is in each case delayed by a time duration $t_{HSS_a}$. The entire time duration during which the bypass is used is identified as $t_{HSS}$ and the time duration during which energy is output to the primary side of step-up transformer 2 is identified as $t_i$. The starting point in time of $t_{HSS}$ in relation to $t_i$ may be variably selected.

Figure 4:
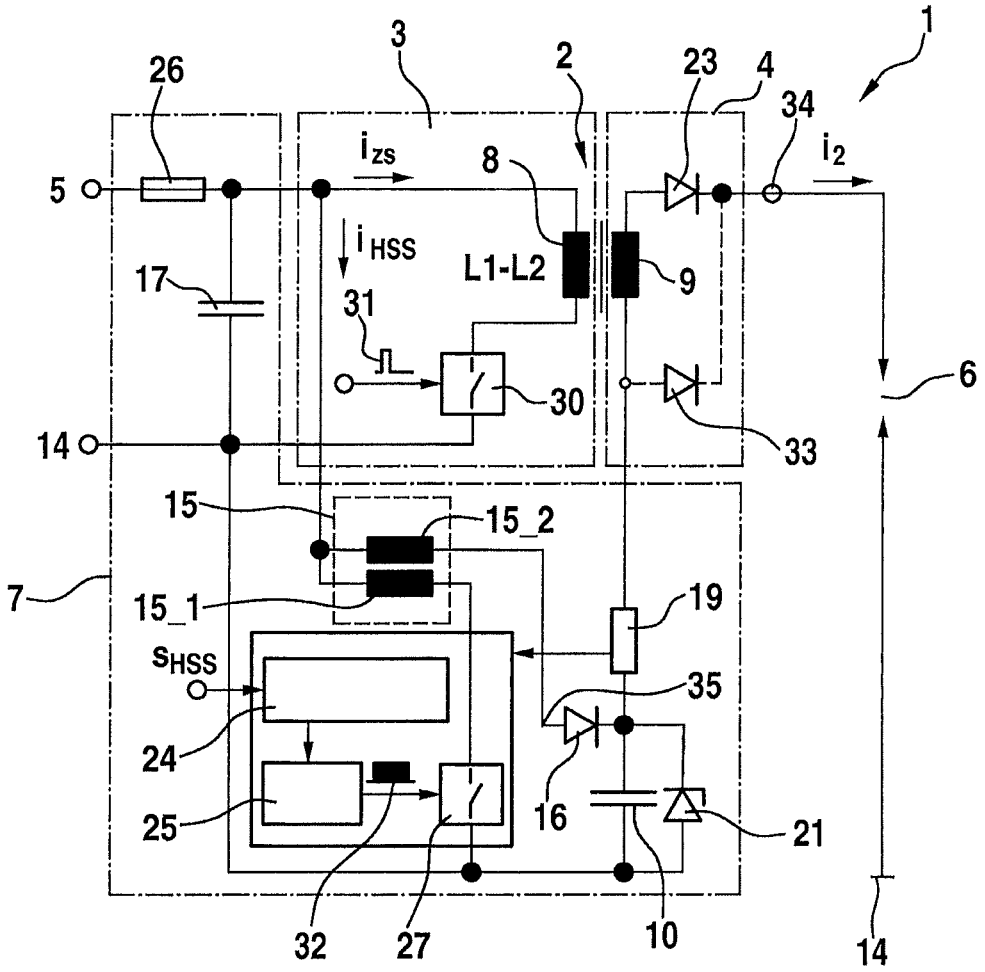
FIG. 4 shows a wiring diagram according to a second exemplary embodiment of an ignition system according to the present invention.

FIG. 4 shows a specific embodiment, which is an alternative to FIG. 2, of a circuit of an ignition system 1 according to the present invention. At the input of the circuit, i.e., in other words at the terminal to electrical energy source 5, a fuse 26 is provided. To stabilize the input voltage, a capacitance 17 is moreover provided in parallel to the input of the circuit or in parallel to electrical energy source 5. Furthermore, inductance 15 has been replaced by a transformer having a primary side 15_1 and a secondary side 15_2, primary side 15_1 having a primary coil and secondary side 15_2 having a secondary coil. The first terminals of the transformer are connected to electrical energy source 5 and fuse 26 in each case. Here, a second terminal of primary side 15_1 is connected to electrical ground 14 via a switch 27. The second terminal of secondary side 15_2 of transformer 15 is now connected directly to diode 16 without a switch. Due to the transfer ratio, a switching operation also has an effect on secondary side 15_2 through switch 27 in the branch of primary side 15_1. Since, however, the current and the voltage are higher and lower, respectively, on the one side of transformer 15 than on the other according to the transmission ratio, switching operations of more cost-effective dimensions may be found for switch 27. For example, lower switching voltages may be implemented, whereby the dimensions of switch 27 may be made simpler and more cost-effective. Switch 27 is controlled via an activation 24 which is connected to switch 27 via a driver 25. As shown in FIG. 2, a shunt 19 is provided to measure current $i_2$ on the secondary side or the voltage across capacitance 10 and to make it available to activation 24 of switch 27. Moreover, activation 24 receives a control signal $s_{HSS}$. It may be used to switch the input of energy into the secondary side via the bypass on and off. For this purpose, the power of the electrical variable input through the bypass or into the spark gap may also be controlled via a suitable control signal, in particular via the frequency and/or the pulse-pause ratio. Optionally, a nonlinear two-terminal network, in the following symbolized by a high voltage diode 33, of the secondary-side coil of the boost converter may be switched in parallel. This high voltage diode 33 bridges high voltage generator 2 on the secondary side, whereby the energy supplied by bypass 7 in the form of a boost converter (enclosed by a dot and dash line) is guided directly to spark gap 6, without being guided through secondary coil 9 of high voltage generator 2. Thus, losses do not develop across secondary coil 9 and the degree of efficiency increases. The remaining elements of the drawing illustrated in FIG. 4 correspond to those shown in FIG. 2 and have already been discussed above.

Figure 5:
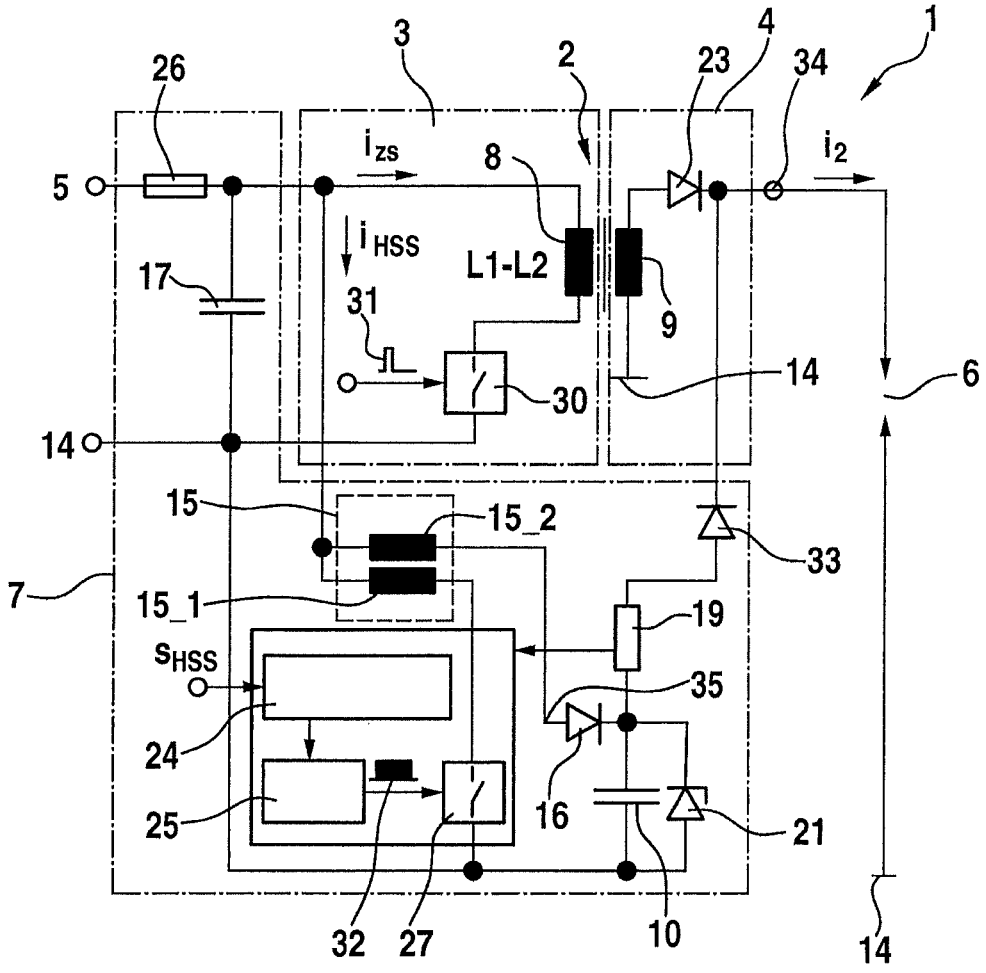
FIG. 5 shows a wiring diagram according to a third exemplary embodiment of an ignition system according to the present invention.

FIG. 5 shows one alternative specific embodiment of the circuit presented in FIG. 4. A high voltage diode 33 is situated therein having a flow direction toward the spark gap between energy store 10 of bypass 7 in the form of a boost converter (enclosed by a dot and dash line) and spark gap 6. In this way, high voltage diode 33 bridges high voltage generator 2 on the secondary side, whereby the energy supplied by bypass 7 is guided directly to spark gap 6, without being guided through secondary coil 9 of high voltage generator 2. Thus, losses do not develop across secondary coil 9 and the degree of efficiency increases.

Figure 6:
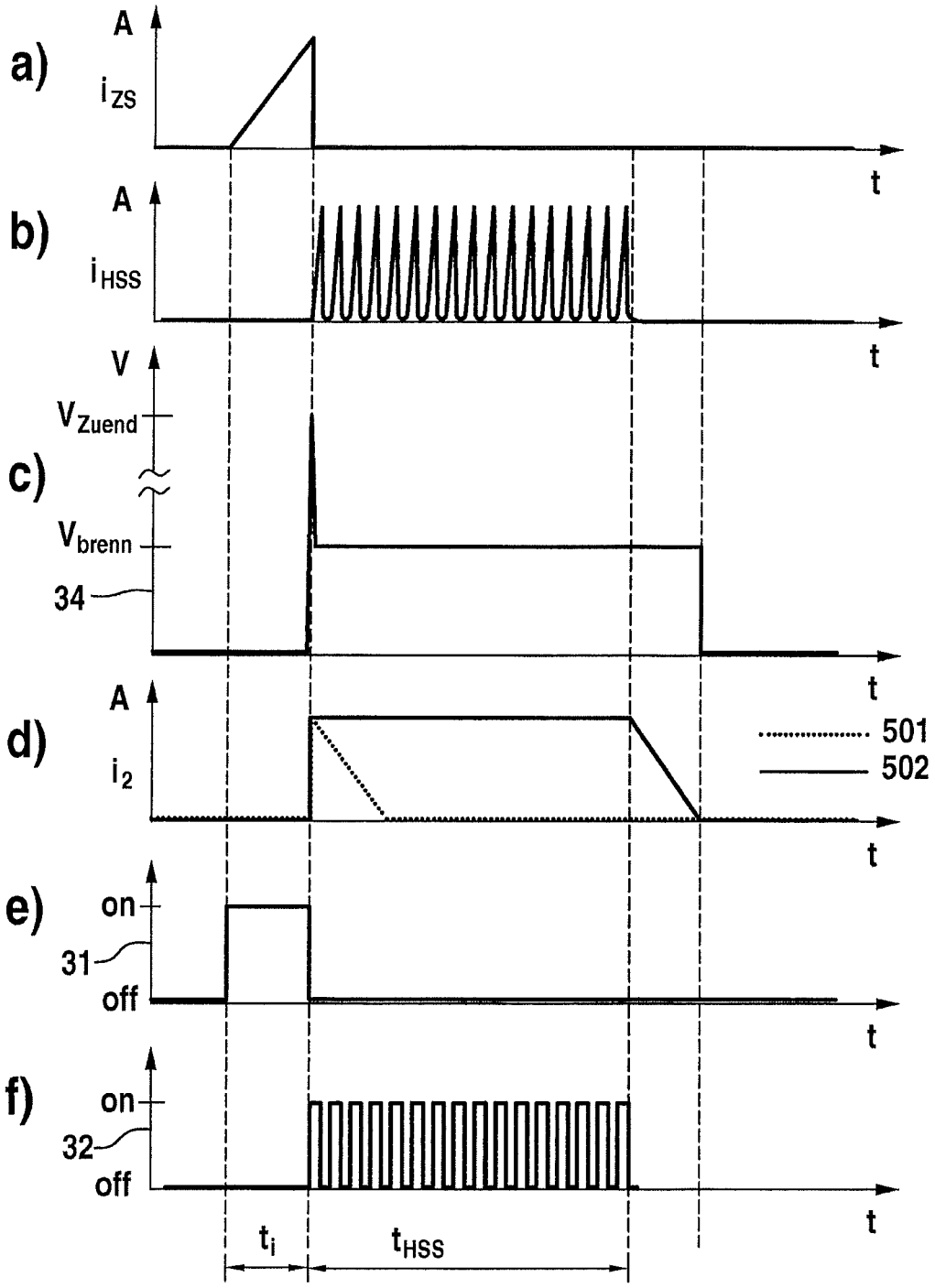
FIG. 6 shows representations of current-time diagrams as well as the associated switching sequences for the circuit shown in FIG. 4 and FIG. 5.

FIG. 6 shows time diagrams for a) ignition coil current $i_{ZS}$, b) bypass current $i_{HSS}$, c) output-side voltage across spark gap 6, d) secondary coil current $i_2$ for the ignition system illustrated in FIG. 4 without (501) and with (502) the utilization of the bypass according to the present invention, e) switching signal 31 of switch 30, and f) switching signal 32 of switch 27 for the pulse signal in bypass 7. For the sake of conciseness, reference is made to the discussion above with regard to the diagrams shown already in conjunction with FIG. 3. Diagram b) moreover illustrates the current consumption of bypass 7 according to the present invention which results from a pulse-like activation of switch 27. In practice, clock rates in the range of several ten kHz have been tried and tested as a switching frequency in order to implement, on the one hand, appropriate voltages and, on the other hand, acceptable degrees of efficiency. As an example, the integral multiples of 10,000 Hz in the range between 10 kHz and 100 kHz are named as possible range boundaries. To control the power output to the spark gap, an, in particular, continuous control of the pulse-pause ratio of signal 29 or 32 is recommended in this case for generating a corresponding output signal. In addition, it is also possible to increase the voltage delivered by the electrical energy source with the aid of an additional DC-DC converter before this voltage is further processed in the bypass according to the present invention. It should be noted that concrete specifications depend on many circuit-related and external boundary conditions. It does not present any unacceptable problems to those skilled in the art to implement suitable dimensions themselves for their own purpose and for the boundary conditions which are to be observed by them.

The present invention provides, among other subjects, the following:

1. An ignition system (1), including
   - at least one high voltage generator (2) having a primary side (3) and a secondary side (4) in each case,
   - an electrical energy source (5) which is connectable to the primary side (3), and
   - a spark gap (6) which is configured to guide a current transferred by the high voltage generator (2) to the secondary side (4), wherein
   - the high voltage generator (2) includes a bypass (7) for transferring electrical energy to the secondary side (4).
2. The ignition system as recited in subject matter 1, wherein
   - the high voltage generator (2) is designed as a step-up transformer and includes a primary coil (8) on the primary side and a secondary coil (9) on the secondary side,
   - the bypass (7) is configured to generate a voltage which is added to a voltage applied to the secondary coil (9) or is supplied in parallel to the secondary coil, and in particular an input capacitance (17) is provided in parallel to the energy source (5).

3. The ignition system as recited in one of the preceding subject matters,
wherein the bypass (7) includes an energy store (10), e.g., a capacitance, whose
first terminal is connected to a secondary-side terminal of the high voltage generator (2) and whose
second terminal is connected to the electrical ground (14), in particular
an inductance (15) being provided, preferably switchably, between the energy source (5) and the energy store (10).

4. The ignition system as recited in one of the preceding subject matters,
wherein, between the inductance (15) and the energy store (10), a first nonlinear two-terminal network (16) is provided, e.g., in the form of a first diode, which has a flow direction in the direction of the capacitance (10), and in particular
a switchable connection is provided between a shared terminal between the inductance (15) and the first nonlinear two-terminal network (16) on the one hand and the electrical ground (14) on the other hand.

5. The ignition system as recited in one of the preceding subject matters,
wherein
a means is provided for measuring the current (19) and/or for measuring the voltage and/or for measuring the power, in particular a shunt resistor for measuring the ignition current or the voltage across the energy store (10) which is configured to output a signal for activating at least one switch (22, 27) in the bypass (7) and/or
a second nonlinear two-terminal network (21), in particular in the form of a second diode, protects same against overvoltage in parallel to the energy store (10).

6. The ignition system as recited in one of the preceding subject matters 3 through 5,
wherein the inductance (15) is designed as a transformer having a primary side (15_1) and a secondary side (15_2), a first terminal of the primary side (15_1) being connected to the energy source (5) and a second terminal of the primary side (15_1) being connected via a switch (27) to the electrical ground (14), and
a first terminal of the secondary side (15_2) is connected to the energy source (5) and a second terminal of the secondary side (15_2) is connected to the first nonlinear two-terminal network (16).

7. The ignition system as recited in one of the preceding subject matters,
wherein the bypass (7) includes a boost converter and/or the high voltage generator (2) is bridged on the secondary side by a third nonlinear two-terminal network (33), in particular in the form of a third diode.

8. A method for generating an ignition spark for an internal combustion engine, including the steps of:
generating an ignition spark with the aid of electrical energy which is retrieved from an energy source (5) and which is provided to a spark gap (6) via a high voltage generator (2), in particular a step-up transformer, having a primary side (3) and a secondary side (4), characterized by
maintaining the ignition spark with the aid of electrical energy which is transferred from the energy source (5) to the secondary side (4) via a bypass (7).

9. The method as recited in subject matter 8, wherein
the electrical energy for maintaining the ignition spark is coupled as an electrical voltage in series or in parallel to the secondary side (4) of the high voltage generator (2) and/or
the electrical energy for maintaining the ignition spark is provided from the energy source (5) via a controlled pulse sequence, in particular in the kilo-hertz range, preferably between 10 kHz and 100 kHz.

10. The method as recited in subject matter 8 or 9, wherein
the electrical energy for maintaining the ignition spark reaches the spark gap (6) via a boost converter in the bypass (7).

It is a central idea of the present invention to advantageously separate according to the present invention two functions which have combined the step-up transformers of known ignition systems to facilitate a suitable dimensioning of the high voltage generator and a more efficient utilization of the electrical energy. For this purpose, a high voltage generator is provided to generate an ignition spark according to the related art. A bypass is configured to maintain the existing electric arc across the spark gap. For this purpose, a bypass retrieves energy from the same energy source, for example, as the primary side of the high voltage generator and uses it to support the subsiding edge of the transformer voltage and to thus delay its dropping below the burning voltage. Those skilled in the art recognize preferred specific embodiments of the bypass according to the present invention as circuit structures working in the manner of a boost converter. In this case, the input of the boost converter is switched in parallel to the electrical energy source while the output of the boost converter is situated in series or in parallel to the secondary coil of the high voltage generator. Within the scope of the present invention, the term "energy source" is to be construed in a wide sense and may include other energy converting devices (e.g., DC-DC converters). Moreover, it is apparent to those skilled in the art that the inventive idea is not limited to an objective energy source.

Even though the aspects according to the present invention and the advantageous specific embodiments have been described in detail based on the exemplary embodiments explained in conjunction with the appended drawing figures, modifications and combinations of features of the illustrated exemplary embodiments are possible for those skilled in the art, without departing from the scope of the present invention whose scope of protection is defined by the appended claims.

What is claimed is:

1. An ignition system, comprising:
at least one high voltage generator having a primary side and a secondary side;
an electrical energy source configured to be selectably connected to the primary side; and
a spark gap configured to guide a current transferred by the high voltage generator to the secondary side, wherein the high voltage generator includes a bypass for transferring electrical energy directly to a terminal of the secondary side bypassing the primary side, and wherein the bypass is configured to transfer electrical energy in series or in parallel directly to the terminal of the secondary side and bypass the primary side of the high voltage generator for maintaining an ignition spark as an electrical voltage in a form of a pulse sequence within a kilo-hertz range.

2. The ignition system as recited in claim 1, wherein a coupling section of the bypass forms, in conjunction with a secondary coil of the high voltage generator, a loop having a voltage which is in parallel to the spark gap.

3. The ignition system as recited in claim 2, wherein the pulse sequence has a frequency between 10 kHz and 100 kHz.

4. The ignition system as recited in claim 3, wherein:

the high voltage generator is a step-up transformer and includes a primary coil on the primary side and a secondary coil on the secondary side;

the bypass is configured to generate a voltage which is one of (i) added to a voltage applied to the secondary coil or (ii) supplied in parallel to the secondary coil; and an input capacitance is provided in parallel to the energy source.

5. The ignition system as recited in claim 3, wherein the bypass includes an energy store having (i) a first terminal connected to a secondary-side terminal of the high voltage generator and (ii) a second terminal connected to the electrical ground, and wherein an inductance is switchably provided between the energy source and the energy store.

6. The ignition system as recited in claim 5, wherein;

between the inductance and the energy store a first nonlinear two-terminal network in the form of a first diode is provided which has a flow direction in the direction of the capacitance; and a switchable connection is provided between (i) a shared terminal of the inductance and the first nonlinear two-terminal network, and (ii) the electrical ground.

7. The ignition system as recited in claim 6, wherein the switchable connection includes a transistor switch.

8. The ignition system as recited in claim 3, wherein:

the bypass has an inductance, a capacitance, a diode, and a switch;

a first terminal of the inductance is connected to the energy source;

a second terminal of the inductance is connected to a first terminal of the diode;

the switch is configured to connect one of the second terminal or a third terminal of the inductance to the electrical ground;

a second terminal of the diode is connected to a first terminal of the capacitance;

a second terminal of the capacitance is connected to the electrical ground; and a Zener diode of the capacitance is switched in parallel.

9. The ignition system as recited in claim 8, wherein at least one of:

a shunt resistor is provided for (i) measuring one of the current and the voltage across the energy store and (ii) outputting a signal for activating at least one switch in the bypass; and a second nonlinear two-terminal network in the form of a second diode protects against overvoltage in parallel to the energy store.

10. The ignition system as recited in claim 5, wherein the inductance is a transformer having a primary side and a secondary side, a first terminal of the primary side being connected to the energy source and a second terminal of the primary side being connected via a switch to the electrical ground, and a first terminal of the secondary side is connected to the energy source and a second terminal of the secondary side is connected to the first nonlinear two-terminal network.

11. The ignition system as recited in claim 9, wherein at least one of (i) the bypass includes a boost converter and (ii) the high voltage generator is bridged on the secondary side by a third nonlinear two-terminal network in the form of a third diode.

12. A method for generating an ignition spark for an internal combustion engine, comprising:

generating an ignition spark with electrical energy which is retrieved from an energy source and which is provided to a spark gap via a high voltage generator having a primary side and a secondary side; and maintaining the ignition spark by applying pulsed electrical energy which is transferred from the energy source directly to a terminal of the secondary side via a bypass that bypasses the primary side.

13. The method as recited in claim 12, wherein at least one of:

the electrical energy for maintaining the ignition spark as an electrical voltage is transferred via the bypass in series or in parallel directly to the terminal of the secondary side of the high voltage generator; and the electrical energy for maintaining the ignition spark is provided from the energy source to the secondary side of the high voltage generator via the bypass.

14. The method as recited in claim 13, wherein the electrical energy for maintaining the ignition spark reaches the spark gap via a boost converter in the bypass.

15. The method as recited in claim 12, wherein the high voltage generator is a step-up transformer and includes a primary coil on the primary side and a secondary coil on the secondary side.

16. An ignition system, comprising:

at least one high voltage generator having a primary side and a secondary side;

an electrical energy source which is connectable to the primary side; and a spark gap which is configured to guide a current transferred by the high voltage generator to the secondary side, the high voltage generator including a bypass for transferring electrical energy to the secondary side, wherein the ignition system is configured by the bypass to supply electrical energy as an electrical voltage in the form of a pulse sequence in series or in parallel to the secondary side of the high voltage generator for the purpose of maintaining an ignition spark, the voltage generator being designed as a step-up transformer and including a primary coil on the primary side and a secondary coil on the secondary side, the bypass being configured to generate a voltage which is added to a voltage applied to the secondary coil or supplied in parallel to the secondary coil, an input capacitance being provided in parallel to the electrical energy source.

17. The ignition system as recited in claim 16, wherein the pulse sequence is in a kilohertz range.

18. The ignition system as recited in claim 16, wherein a coupling section of the bypass forms a loop, whose voltage is in parallel to the spark gap, in conjunction with a secondary coil of the high voltage generator.

19. The ignition system as recited in claim 16, wherein the pulse sequence has a frequency between 10 and 100 kHz.

* * * * *